United States Patent [19]

Eger

[11] Patent Number: 4,476,956

[45] Date of Patent: Oct. 16, 1984

[54] SLIDE FOR FRICTIONAL ENGAGEMENT WITH FLEXIBLE DESCENT LINE

[76] Inventor: Leroy O. Eger, 2320 N. 33rd St., Lighthouse Point, Fla. 33064

[21] Appl. No.: 526,671

[22] Filed: Aug. 26, 1983

[51] Int. Cl.[3] ..... A62B 1/14; A62B 1/20

[52] U.S. Cl. ..... 182/5; 182/72; 182/193; 188/65.5

[58] Field of Search ..... 182/5, 6, 7, 18, 193, 182/72; 188/65.1, 65.2, 65.3, 65.4, 65.5

[56] References Cited

U.S. PATENT DOCUMENTS

| | | | |
|---|---|---|---|
| 219,511 | 9/1879 | Petterson | 182/7 |
| 263,100 | 8/1882 | Beebe | 188/65.5 |
| 287,491 | 10/1883 | Woodward | 182/5 |
| 1,059,754 | 4/1913 | Paquet | 182/193 |
| 1,135,248 | 4/1915 | Ball | 182/5 |
| 1,187,754 | 6/1916 | Lyra | 188/65.5 |
| 3,220,511 | 11/1965 | Holkesvick | 182/5 |
| 3,550,726 | 12/1970 | Chezen | 182/193 |
| 3,765,507 | 10/1973 | Rabelos | 182/5 |
| 4,024,927 | 5/1977 | Sheppard | 182/5 |
| 4,056,166 | 11/1977 | Rabelos | 182/5 |
| 4,102,431 | 7/1978 | Carroll | 188/65.5 |
| 4,399,889 | 8/1983 | Todd | 182/193 |

*Primary Examiner*—Reinaldo P. Machado
*Attorney, Agent, or Firm*—Oltman and Flynn

[57] ABSTRACT

A slide for frictionally engaging a flexible line to control a person's descent along the line. An outer shell has a helical opening in one side with a longitudinal offset at its lower end for receiving the line. An inner friction member, which is adjustable rotationally and longitudinally inside the outer shell, has a transverse slot in its inner end and a helical screw thread behind for frictionally receiving the line. Indicia on the friction member are visible at an opening in the outer shell to show the body weight for which the slide has been adjusted. The slide has a fail-safe lock acting between the outer shell and the friction member.

13 Claims, 14 Drawing Figures

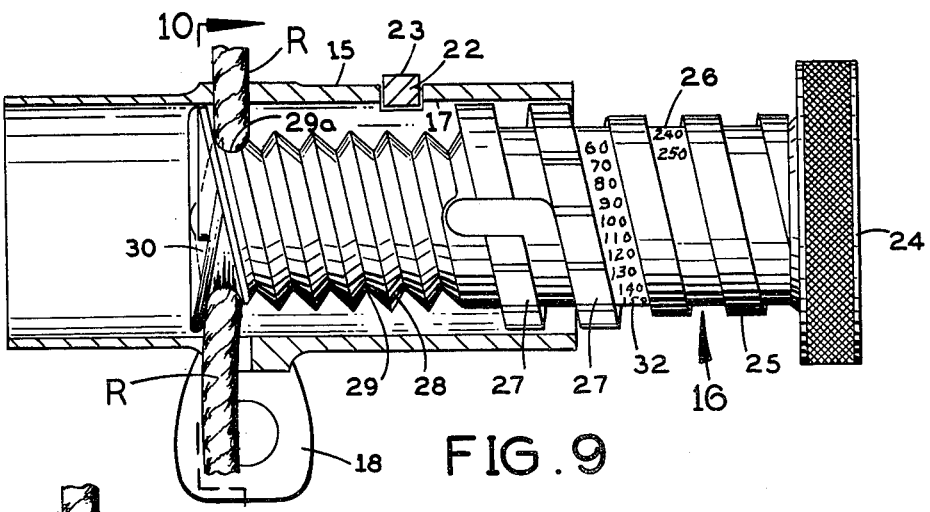
FIG. 9
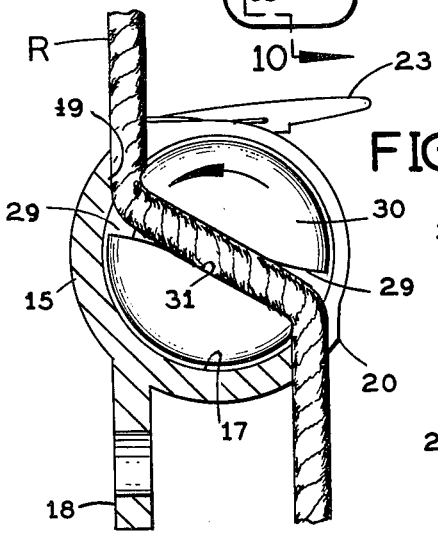
FIG. 10
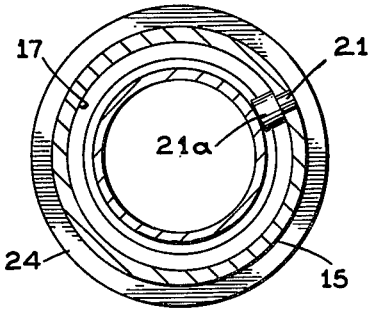
FIG. 8
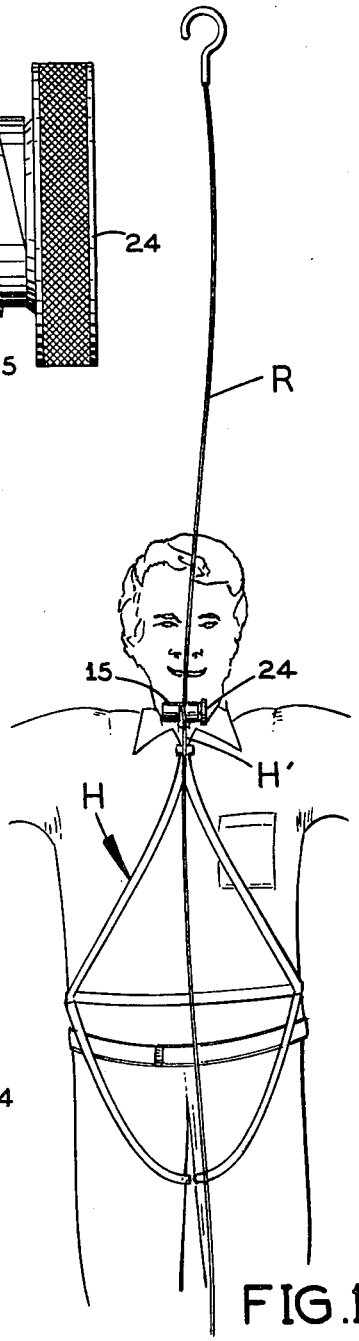
FIG. 13
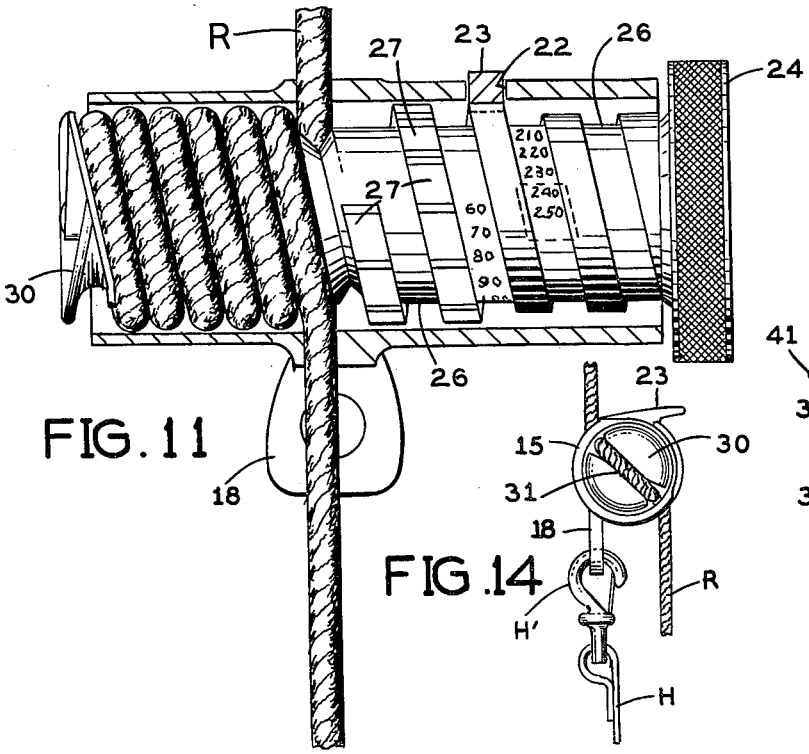
FIG. 11
FIG. 14
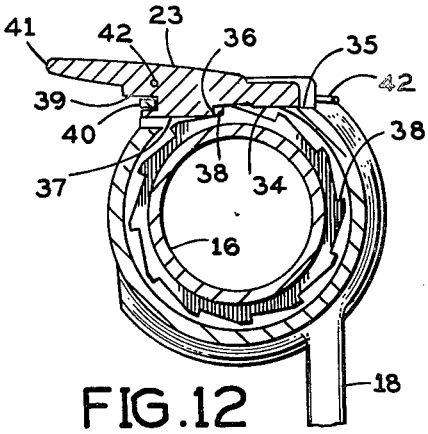
FIG. 12

SLIDE FOR FRICTIONAL ENGAGEMENT WITH FLEXIBLE DESCENT LINE

SUMMARY OF THE INVENTION

This invention relates to a slide for frictional engagement with a flexible line to control a person's descent along the line.

Various fire escape devices have been proposed heretofore in which a slide is frictionally engageable with a downwardly extending rope. Typically the slide is attached to a body harness worn by a person who wants to slide down the rope at a conveniently slow speed. The present invention is directed to a slide which may be used for this and other purposes.

In accordance with the present invention, a novel slide is provided which is conveniently adjustable to select the frictional restraint which it exerts on the flexible line, such as in proportion to the weight of the person using the slide so that the person's descent along the line will proceed at a speed which is convenient for that person.

Preferably, the present slide comprises an outer shell having a longitudinal passageway and an inner friction member which is rotatably adjustable along that passageway. The shell has a helical opening in the side leading into its longitudinal passageway for receiving the rope or other flexible line. The inner friction member has a slotted head on its inner end for engaging the line and a helical screw thread behind the head which frictionally engages a length of the line which depends upon how far the slotted head is advanced past the helical opening in the outer shell. That is, the friction between the inner member and the line varies in accordance with the rotational adjustment of the inner member along the inside of the outer shell. Near its outer end the inner friction member has a flat-bottomed helical groove which slidably receives a follower pin on the outer shell, so that rotation of the friction member causes it to be displaced longitudinally of the outer shell. This groove has indicia which are visible through an opening in the outer shell to tell the user the body weight for which the slide has been adjusted to provide a conveniently slow descent along the line. A manually releasable locking device acts between the outer shell and the friction member to permit rotation of the friction member in the direction for increasing the friction on the line but not in the opposite direction (for reducing the friction on the line) unless the locking device is deliberately moved to a release position.

A principal object of this invention is to provide a novel slide for frictional engagement with a flexible line to permit a person to descend along the line at a suitably slow speed.

Another object of this invention is to provide such a slide having a novel arrangement for selectively varying the frictional restraint which it exerts on the line.

Another object of this invention is to provide such a slide which has a visible display arrangement for telling the user the body weight for which the slide has been adjusted to enable the user to descend at a conveniently slow speed.

Another object of this invention is to provide such a slide which is adjustable to vary the frictional restraint it applies to the line and which has a manually releasable lock which enables that frictional restraint to be increased but not decreased unless the user releases the lock.

Further objects and advantages of this invention will be apparent from the following detailed description of a presently preferred embodiment which is illustrated schematically in the accompanying drawings.

DESCRIPTION OF THE DRAWINGS

FIG. 8 is a cross-section taken along the line 8—8 in FIG. 3;

FIG. 9 is a view showing the outer shell of the slide in longitudinal section and the inner friction member of the slide in elevation in the position in which it exerts minimum frictional restraint on the rope;

FIG. 10 is a cross-section taken along the line 10—10 in FIG. 9;

FIG. 11 is a view similar to FIG. 9 and showing the inner friction member adjusted to the position in which it exerts the maximum frictional restraint on the rope;

FIG. 12 is a cross-section taken along the line 7—7 in FIG. 2 but with the locking lever in its locked position;

FIG. 13 shows a person wearing a body harness to which the present slide is attached for descending along a fire escape rope; and FIG. 14 is a fragmentary end elevation showing the attachment of the present slide to the body harness.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 2:
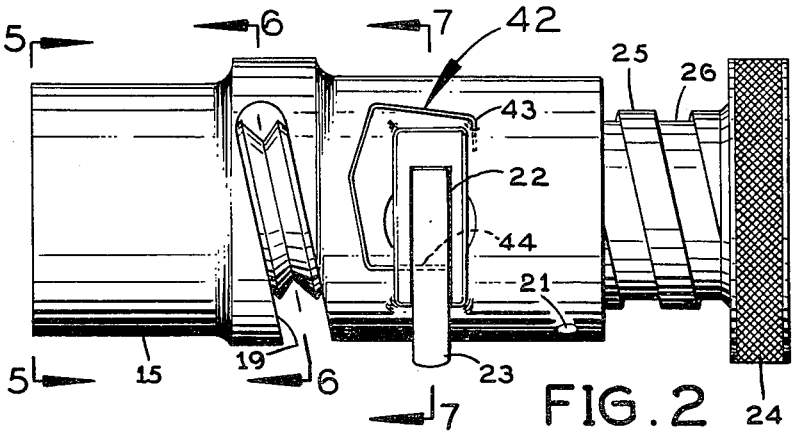
FIG. 2 is a longitudinal side elevation of the present slide.

Referring first to FIGS. 2 and 9, the principal parts of the present slide are a rigid outer shell 15 and a rigid inner friction member 16 which is rotatably adjustable along the inside of the outer shell.

As shown in FIG. 9, the outer shell 15 has a longitudinal passageway 17 of circular cross-section which extends the entire length of the outer shell and is open at each end. On the outside the outer shell has an integrally formed "eye" 18 for attachment to a harness hook, as explained hereinafter.

Figure 3:
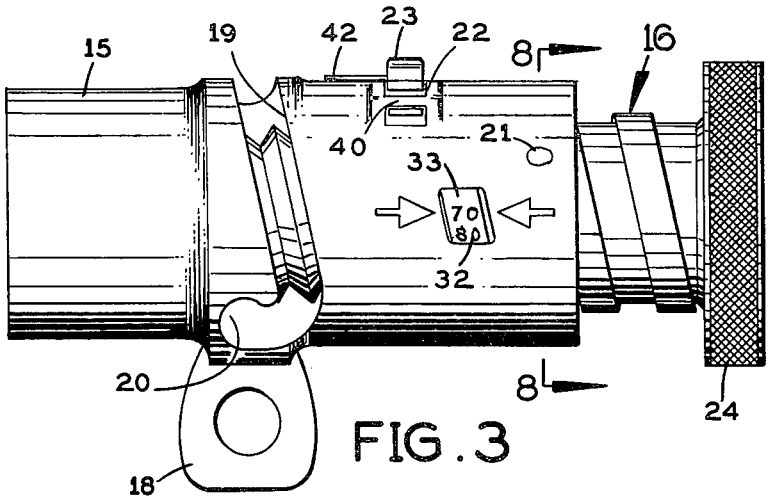
FIG. 3 is a side elevation taken from the bottom of FIG. 2.
Figure 4:
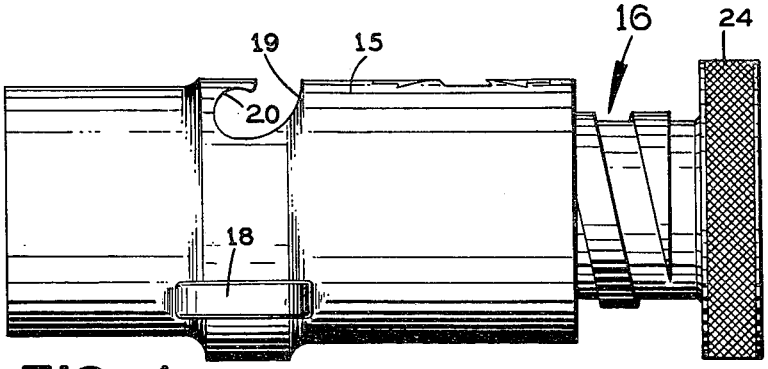
FIG. 4 is a side elevation of the slide taken at the opposite side from FIG. 2.
Figure 5:
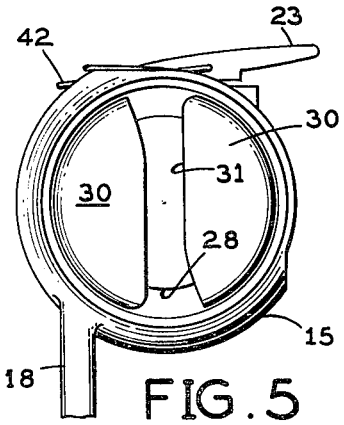
FIG. 5 is an end elevation taken along the line 5—5 in FIG. 2.
Figure 6:
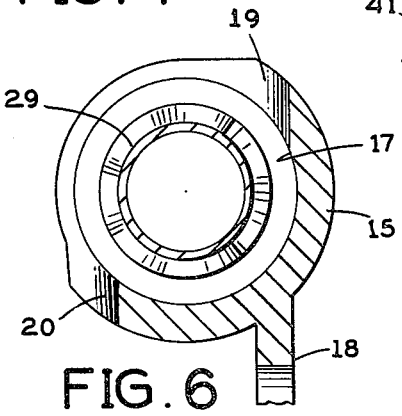
FIG. 6 is a cross-section taken along the line 6—6 in FIG. 2.

About midway along its length the outer shell is formed with a helically extending opening 19 in its side wall which, as shown in FIG. 6, extends about halfway around the circumference of the side wall. As shown in FIGS. 3 and 4, at one end this helically extending opening 19 leads into a recess 20 which is offset forwardly along the outer shell (i.e., to the left in these Figures).

Toward its back end (i.e., the right end in FIGS. 2–4, 9 and 11) the outer shell 15 carries an inwardly projecting guide pin 21. As shown in FIG. 8, this guide pin has an enlarged cylindrical segment 21*a* on its inner end which is located inside the longitudinal passageway 17 through the outer shell.

Between the guide pin 21 and the helical opening 19 in its side wall the outer shell is formed with another opening 22 (FIGS. 2 and 3) in its side wall for receiving a ratchet release lever 23, as explained in more detail hereinafter. The opening 22 extends part way around the circumference of the outer shell's side wall.

Figure 7:
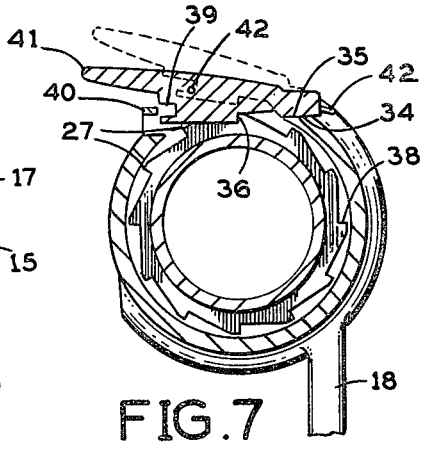
FIG. 7 is a cross-section taken along the line 7—7 in FIG. 2, with the locking lever in the position to which it is spring-biased.

The inner friction member 16 of the present slide has an enlarged knurled head 24 on its back end (the right end in FIGS. 2–4, 9 and 11), which is of larger diameter than the outer shell 15. A helically grooved guide segment 25 extends forward from this head (i.e., to the left in FIGS. 2–4, 9 and 11) and is rotatably received in the longitudinal passageway 17 in the outer shell 15. Guide segment 25 presents a helically-wound, flat-bottomed groove 26 which, as shown in FIG. 8, slidably receives the friction end segment 21*a* of the guide pin 21 carried by the outer shell 15. Guide pin 21 and groove 26 cooperate to cause the friction member 16 to be displaced longitudinally of the outer shell in proportion to how far the friction member is rotated relative to the outer shell. The guide segment 25 is slightly larger in cross-section at its innermost two turns than at the remaining turns, and at these larger turns it has a snug but slidable fit inside the outer shell 15. At these larger turns the guide segment is formed with a series of ratchet teeth 27 in close succession circumferentially, as shown in FIG. 7, for locking engagement by the ratchet release lever 23 on the outer shell 15, as explained hereinafter.

The friction member 16 presents an externally screw-threaded segment 28 (FIG. 9) extending forward from its helically grooved guide segment 25 and having a substantial radial clearance inside the passageway 17 in the outer shell 15. Segment 28 presents several turns of a V-shaped groove 29 of the same helical pitch as the flat-bottomed groove 26 in guide segment 25 of the inner member. At the forward-most turn of segment 28 its helical groove becomes a round-bottomed groove, as shown at 29*a* in FIGS. 9 and 11.

At the front end of its screw-threaded segment 29 the friction member 16 terminates in an enlarged head 30 whose peripheral edge has a snug sliding fit inside the passageway 17 in the outer shell, as shown in FIGS. 9 and 10. Head 30 is formed with a diametrically extending groove or recess 31 in its front end. The opposite end of groove 31 in the head open into the round-bottomed groove 29*a* in the screw-threaded segment 28 behind the head.

Figure 1:
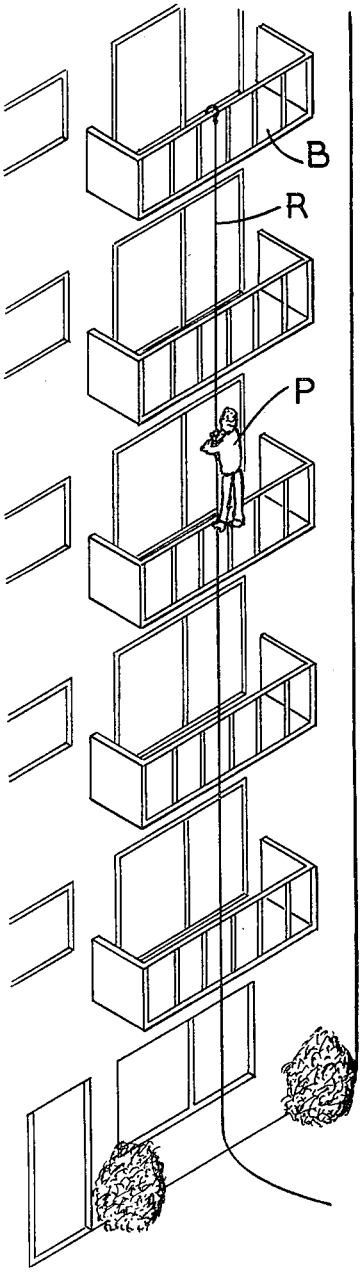
FIG. 1 is a perspective view showing a person using the present slide to descend along a fire escape rope on the outside of a multi-story building.

FIG. 1 shows the present slide used by a person P to descend from a balcony B on the outside of a multistory building to the ground. This is just one possible use of the present invention. A rope R or other flexible line hangs down from the balcony railing to the ground and it passes between the outer shell 15 and the inner friction member 16 of the present slide, which cooperate to exert a frictional restraint against the rope that slows the descent of the person carrying the slide. As shown in FIG. 13, the person using the present device may wear a body harness H having a hook H′ at its upper end for engagement with the eye 18 on the outer shell 15 so as to position the present invention in front of the person's chin. This is just one possible way of attaching the present slide to the body of the person who will use it to slide down the rope R.

As shown in FIG. 9, before the present slide is applied to the rope R the inner member 16 is retracted to a position in which the recess or slot 31 in the front of its front end head 30 registers with the helical opening 19 in the side wall of outer shell 15. This enables the rope to be inserted from one side of the outer shell via the opening 19 in the latter into the recess or slot 31 on the front end of inner member 16. Following this, the inner friction member 16 is rotated to move the head 30 on its front end to the left in FIGS. 9 and 11, causing the rope R to be wound in the groove 29 on the friction member. The friction between the rope and member 16 is proportional to the length of the rope (i.e., the number of turns) received in the groove 29. The amount of this friction and the weight of the person using this device determine how fast the person will slide down the rope. Preferably, the position of the inner friction member 16 is adjusted so that, whatever the person's weight, the rate of descent will be at a suitably slow speed.

As shown in FIG. 9, the flat-bottomed groove 26 on the friction member 16 is marked with numbers 32 representing a person's weight in pounds. These numbers increase in succession along this groove toward its back end. The outer shell 15 has an opening 33 in its side wall (FIG. 3) through which these numbers 32 are visible in succession as the inner member 16 is rotated. The farther inward the inner member 16 is turned (i.e., to the left in FIGS. 2–4, 9 and 11) the higher will be the weight number 32 appearing in the opening 33 and the greater will be the number of turns of the rope R in the groove 29 on inner member 16. Thus, by rotating the inner member 16 to a position displaying the user's weight in the opening 33 in the outer shell 15, the frictional restraint on the rope R will be adjusted in proportion to the weight displayed.

The locking lever 23 is shown in detail in FIGS. 7 and 12. At its inner end (the right end in these Figures) the locking lever presents a flat bottom face 34 which is slidable across an upwardly-facing flat face 35 on the outer shell 15 at one end of the opening 22. Outward from this bottom face 34 (i.e., to the left in FIGS. 7 and 12) the locking lever presents a downwardly extending shoulder 36 and a flat bottom face 37 extending outward from the lower end of this shoulder. The bottom corner between shoulder 36 and bottom face 37 is slidably engaged by the ratchet teeth 27 on the inner member 16 such that the inner member can be rotated clockwise in FIGS. 7 and 12. However, when the locking lever 23 in the locking position shown in FIG. 12, its shoulder 36 is in the path of movement of the radial face 38 on each ratchet tooth 27, so that counterclockwise rotation of the inner member 16 is prevented while the locking lever 23 is in this position.

The locking lever 23 is formed with a horizontal slot 39 which snugly receives an upwardly offset locking segment 40 on the outside of the outer shell 15, as shown in FIG. 12, to retain the locking lever 23 in its locked position. Outwardly past this slot the locking lever presents an extension 41 which is engageable by the user's finger to adjust the position of the locking lever.

A spring 43 (FIG. 2) acts between the outer shell 15 and the locking lever 23 to bias the locking lever to its unlocked position, shown in full lines in FIG. 7, from which it may be lifted by finger pressure at 41 to the released position shown in phantom in this Figure. This spring is an elongated flexible and resilient wire of generally U-shaped configuration, having one end anchored at 43 in the outer shell and its opposite end anchored at 44 in the locking lever 23 midway along the latter's length. The inherent spring bias of spring 42 is such that it urges locking lever to the position shown in FIG. 7, in which its slot 39 is disengaged from the locking segment 40 on the outer shell. In the phantom line position in FIG. 7, the shoulder 36 on the locking lever is out of the path of the radial face 38 on each ratchet tooth 27 on the inner member 16 so that now the inner member can rotate clockwise.

Tension on the rope, such as due to a person's weight, causes the friction member to rotate counterclockwise in FIG. 7, forcing the locking lever 23 to the locked position shown in FIG. 12, where its slot 39 receives the locking segment 40 on the outer shell.

In the use of this slide, the weight of the person using the slide will exert enough tension on the rope so that the locking lever 23 will be in its locking position (FIG. 12). This permits the friction on the rope to be increased (by rotating the inner member 16 of the slide clockwise in FIG. 12) but it prevents reverse rotation of the inner member 16.

Recapitulating the use and operation of this slide, with the inner member 16 retracted at least to the position shown in FIG. 9, the slide may be applied to the fire escape rope R from the side at the helical opening 19 in the outer shell 15 of the slide. The rope is received in the slot or groove 31 on the inner end of inner member 16. The inner member 16 now may be turned to increase the friction between itself and the rope R, as determined by the length of the rope received in its helical groove 29. This friction is shown by the body weight number which is visible at the opening 33 in the outer shell. If the user turns the inner member 16 too far, so that the frictional restraint on the rope is greater than what he desires, he must shift the locking lever 23 to the release position (shown in phantom in FIG. 7) before the inner member 16 can be turned in the reverse direction so as to reduce the length of the rope R which is received in its groove 29. Once the desired setting has been made, with the locking position (FIG. 12), the person may attach his body harness to the slide and begin his descent along the rope. The locking lever will insure that the same length of the rope R is wrapped around the inner member 16 as the slide moves down the rope.

I claim:

1. In a slide for frictional engagement with a flexible line, said slide having first and second members for receiving the line between them with said second member frictionally engaging the line, the improvement wherein:

one of said members is adjustable with respect to the other to vary the length of the line which is frictionally engaged by said second member;

said first member being an outer shell which has a longitudinal passageway therein and being open on opposite sides of said passageway for passing the line into and out of the shell;

and said second member extending into said passageway in the outer shell and being rotatably adjustable therein to wind a corresponding length of the line frictionally around said second member.

2. A slide according to claim 1, and further comprising lock means preventing said second member from unwinding said length of the line under the weight of a person on the slide.

3. A slide according to claim 1, wherein:

said second member has a spiral groove in its periphery for frictionally receiving the line;

and further comprising:

means acting between said first and second members for displacing said second member longitudinally of said first member when the second member is rotated with respect to said first member.

4. A slide according to claim 3, wherein means acting between said first and second members comprises a follower on one member and a helical groove in the other member slidably receiving said follower.

5. A slide for frictional engagement with a flexible line comprising:

an outer shell having a longitudinal passageway which is open at one end of the shell, at least, and a helical opening extending circumferentially part way around said shell and leading into said longitudinal passageway;

an inner friction member extending longitudinally into said longitudinal passageway in the shell through the open end of the shell, said friction member being rotatably adjustable in said outer shell;

said friction member having a head on its inner end with a transverse groove for slidably receiving the line at said helical opening in the outer shell;

said friction member having a spiral groove behind said head for frictionally receiving the line when said friction member is displaced longitudinally into said longitudinal passageway in the shell;

and means acting between said outer shell and said friction member for displacing said friction member along said longitudinal passageway in the shell in response to rotation of said friction member.

6. A slide according to claim 5, wherein said means acting between said shell and said friction member comprises a follower on the shell projecting laterally into said longitudinal passageway and a helical groove on the friction member slidably receiving said follower.

7. A slide according to claim 5, wherein:

said helical opening in the outer shell substantially matches said spiral groove in the friction member which receives the line;

and said helical opening in the outer shell at one end leads into a recess which is offset longitudinally of the outer shell away from said open end thereof into which said friction member extends.

8. A slide according to claim 5, wherein said means acting between said outer shell and said friction member comprises a follower on the shell projecting laterally into said longitudinal passageway and a helical groove on the friction member which slidably receives said follower.

9. A slide according to claim 6, wherein:

said friction member has numbers thereon which increase progressively along said helical groove which receives said follower;

and said outer shell has an opening for displaying the number which corresponds to the rotational adjustment of said friction member.

10. A slide according to claim 5, and further comprising:

a locking member mounted on said outer shell and having a locking position in which it engages said friction member to permit rotation of the friction member in a direction for advancing said head into the outer shell but preventing rotation of the friction member in the opposite direction;

and spring means biasing said locking member to a position in which it may be disengaged from said friction member to permit rotation of the latter in said opposite direction.

11. A slide according to claim 10, wherein:

said friction member has ratchet teeth in succession circumferentially;

and said locking member has a shoulder for engagement with said ratchet teeth to prevent rotation of the friction member in said opposite direction.

12. A slide according to claim 5, wherein:

said spiral opening in the outer shell substantially matches said spiral groove in the friction member which receives the line;

said helical opening in the outer shell at one end leads into a recess which is offset longitudinally of the outer shell away from said open end thereof into which said friction member extends;

said means acting between said shell and said friction member comprises a follower on the shell projecting laterally into said longitudinal passageway in the shell and a helical groove on the friction member slidably receiving said follower;

said friction member has numbers thereon which increase progressively along said helical groove which receives said follower;

and said outer shell has an opening for displaying the number which corresponds to the rotational adjustment of said friction member;

and further comprising:

a locking member mounted on said outer shell and engageable with said friction member to permit rotation of the friction member in a direction for advancing said head into the outer shell but preventing rotation of the friction member in the opposite direction;

and spring means biasing said locking member to a position in which it may be disengaged from said friction member to permit rotation ofthe latter in said opposite direction.

13. A slide according to claim 12, wherein:

said friction member has ratchet teeth in succession circumferentially;

and said locking member has a shoulder for engagement with said ratchet teeth to prevent rotation of the friction member in said opposite direction.

* * * * *